US009752266B2

(12) United States Patent
Song et al.

(10) Patent No.: US 9,752,266 B2
(45) Date of Patent: Sep. 5, 2017

(54) SUPPORTING STRUCTURE OF TUB FOR A LAUNDRY MACHINE

(75) Inventors: Jung Tae Song, Changwon-si (KR); Ig Geun Kwon, Changwon-si (KR); Suk Yun Moon, Changwon-si (KR); Soo Bong Kim, Changwon-si (KR); Dong Il Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 914 days.

(21) Appl. No.: 13/143,025

(22) PCT Filed: Dec. 30, 2009

(86) PCT No.: PCT/KR2009/007957

§ 371 (c)(1),
(2), (4) Date: Aug. 17, 2011

(87) PCT Pub. No.: WO2010/077087

PCT Pub. Date: Jul. 8, 2010

(65) Prior Publication Data

US 2011/0296877 A1 Dec. 8, 2011

(30) Foreign Application Priority Data

Dec. 30, 2008 (KR) ..... 10-2008-0136405
Dec. 30, 2008 (KR) ..... 10-2008-0136409
(Continued)

(51) Int. Cl.
*D06F 37/20* (2006.01)
*D06F 37/22* (2006.01)
(Continued)

(52) U.S. Cl.
CPC ..... *D06F 37/22* (2013.01); *D06F 37/20* (2013.01); *D06F 39/12* (2013.01)

(58) Field of Classification Search
CPC ..... D06F 37/20; D06F 37/22; D06F 39/125; D06F 39/12
(Continued)

(56) References Cited

U.S. PATENT DOCUMENTS 2,963,892 A * 12/1960 Edwards ..... 68/140
3,089,326 A * 5/1963 James ..... 68/23.2
(Continued)

FOREIGN PATENT DOCUMENTS

CN 1724742 A 1/2006
EP 1 118 703 A1 7/2001
(Continued)

OTHER PUBLICATIONS

Mexican Office Action dated Feb. 17, 2014 issued in Application No. MX/a/2011/007090.
(Continued)

*Primary Examiner* — Michael Barr
*Assistant Examiner* — Irina Graf
(74) *Attorney, Agent, or Firm* — Ked & Associates LLP

(57) ABSTRACT

A supporting structure of a tub for a laundry machine is provided. The laundry machine includes a cabinet to form an outer appearance having a base, a tub arranged in the cabinet, a drum rotatably placed in the tub, a suspension that flexibly supports the drum, and a support, separate from the suspension, provided at the base to support vertically a weight of the tub. Due to the supporting structure of the laundry machine, a capacity of the tub of the laundry machine is increased. A support stability of the capacity-increased tub is enhanced by vertically supporting the weight of the tub.

23 Claims, 11 Drawing Sheets

(30) Foreign Application Priority Data

| | | |
|---|---|---|
| May 28, 2009 | (KR) | 10-2009-0047192 |
| Aug. 27, 2009 | (KR) | 10-2009-0079909 |
| Aug. 27, 2009 | (KR) | 10-2009-0079930 |
| Dec. 30, 2009 | (KR) | 10-2009-0134066 |

(51) Int. Cl.
*D06F 37/26* (2006.01)
*D06F 39/12* (2006.01)

(58) Field of Classification Search
USPC ..... 68/140, 141, 139, 142; 3/140, 141, 139, 3/142
See application file for complete search history.

(56) References Cited

U.S. PATENT DOCUMENTS

| | | | | |
|---|---|---|---|---|
| 5,427,427 | A | 6/1995 | Holter | |
| 5,449,215 | A | 9/1995 | Viertel et al. | |
| 5,477,429 | A | 12/1995 | Viertel et al. | |
| 5,601,766 | A | 2/1997 | Viertel et al. | |
| 5,613,724 | A | 3/1997 | Alula | |
| 5,678,879 | A | 10/1997 | Mailander | |
| 5,979,967 | A | 11/1999 | Poulson | |
| 6,012,757 | A | 1/2000 | Viertel | |
| 6,019,415 | A | 2/2000 | Viertel | |
| 6,309,004 | B1 | 10/2001 | McNutt et al. | |
| 6,406,086 | B2 | 6/2002 | Bauer et al. | |
| 6,435,593 | B2 | 8/2002 | Welter | |
| 6,474,717 | B2 | 11/2002 | Viertel et al. | |
| 6,488,328 | B2 | 12/2002 | Quapil | |
| 6,776,446 | B1 | 8/2004 | Tutt | |
| 7,000,972 | B2 | 2/2006 | Asai | |
| 7,108,309 | B2 | 9/2006 | Garcia | |
| 7,204,543 | B2 | 4/2007 | Mishimagi | |
| 7,216,918 | B1 | 5/2007 | Runfola | |
| 7,325,854 | B2 | 2/2008 | Lanser et al. | |
| 7,338,108 | B2 | 3/2008 | Iwatsuka | |
| 7,784,847 | B2 | 8/2010 | Asai | |
| 7,802,836 | B2 | 9/2010 | Baudouin | |
| 7,818,907 | B1 | 10/2010 | Warrington, Jr. | |
| 2002/0074838 | A1 | 6/2002 | Whiting et al. | |
| 2004/0066056 | A1 | 4/2004 | Mills | |
| 2006/0208530 | A1 | 9/2006 | Mishimagi | |
| 2006/0243003 | A1 * | 11/2006 | Chang | D06F 7/206 68/3 R |
| 2007/0227200 | A1 | 10/2007 | Kim et al. | 68/140 |
| 2009/0044574 | A1 | 2/2009 | Lim et al. | |

FOREIGN PATENT DOCUMENTS

| | | | | |
|---|---|---|---|---|
| EP | 1 710 340 | A2 | 10/2006 | |
| EP | 1 849 905 | A1 | 10/2007 | |
| EP | 2 387 632 | A2 | 11/2011 | |
| GB | 2 238 090 | A | 5/1991 | |
| JP | 7-124382 | | 5/1995 | |
| JP | 2004-305709 | | 11/2004 | |
| JP | 2004-344373 | | 12/2004 | |
| KR | 10-2004-0046973 | | 6/2004 | |
| KR | 10-2004-0058998 | | 7/2004 | |
| KR | 10-2005-0068527 | | 7/2005 | |
| KR | 10-2005-0117004 | | 12/2005 | |
| KR | 10-2006-0064188 | | 6/2006 | |
| KR | 10-2006-0085812 | | 7/2006 | |
| KR | 10-2006-0089083 | | 8/2006 | |
| KR | 10-2007-0067464 | | 6/2007 | |
| KR | 10-2007-0101688 | | 10/2007 | |
| KR | 10-2007-0101732 | A | 10/2007 | |
| KR | 10-0777299 | | 11/2007 | |
| KR | 10-2008-0018154 | A | 2/2008 | |
| KR | 10-0808192 | B1 | 2/2008 | |
| RU | 2 300 591 | C1 | 6/2007 | |
| UA | 5739 | C1 | 12/1994 | |
| UA | 9459 | U | 9/2005 | |
| UA | 94680 | C2 | 5/2011 | |
| WO | WO 2004/097098 | A1 | 11/2004 | |
| WO | WO 2004097098 | A1 * | 11/2004 | D06F 29/00 |
| WO | WO 2007/105843 | A1 | 9/2007 | |

OTHER PUBLICATIONS

International Search Report and Written Opinion dated Jun. 24, 2011 issued in Application No. PCT/KR2009/007957.
Ukraine Office Action dated Feb. 15, 2012 issued in Application No. 2011 09557.
Ukraine Decision of Grant dated May 18, 2012 issued in Application No. 2011 09557.
European Search Report dated Jun. 22, 2012 issued in Application No. 09836408.
Chinese Office Action dated Sep. 5, 2012 issued in Application. No. 2009-80155504 (with English Translation).
Russian Office Action dated Sep. 5, 2013 issued in Application No. 2011132070/12 (with English translation).
Russian Notice of Allowance dated Dec. 25, 2013 issued in Application No. 2011132070 (with English translation).
Korean Office Action dated Sep. 21, 2016 issued in Application No. 10-2010-0046457.
Korean Office Action dated Oct. 18, 2016 issued in Application No. 10-2010-0047412.

* cited by examiner

[Fig. 1]
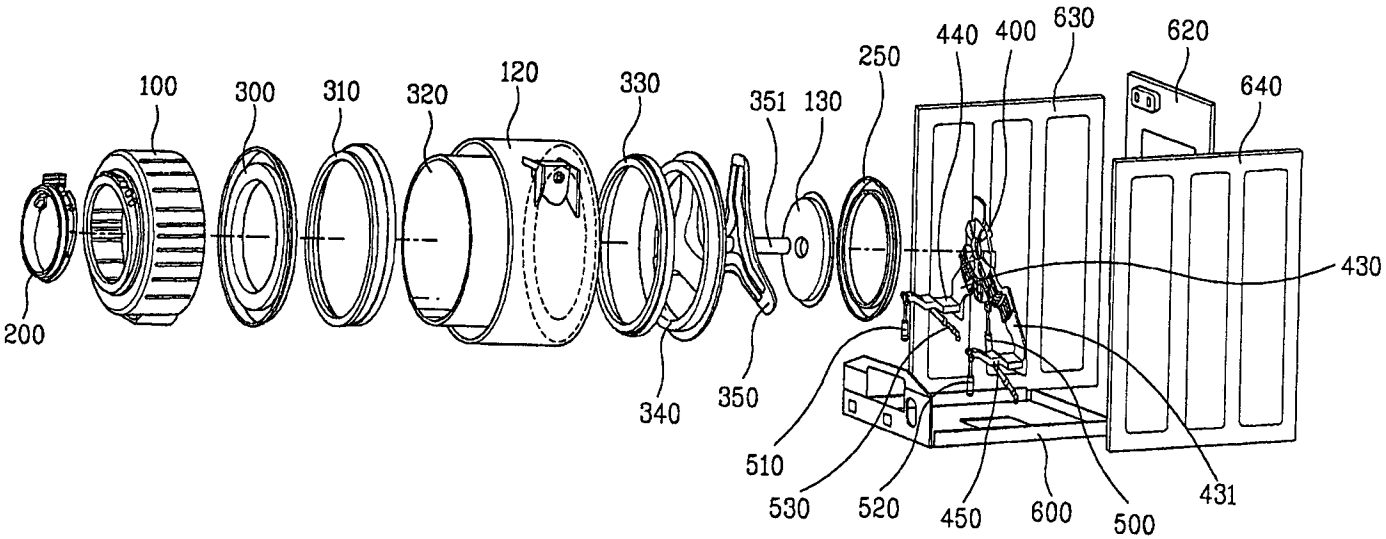

[Fig. 2]
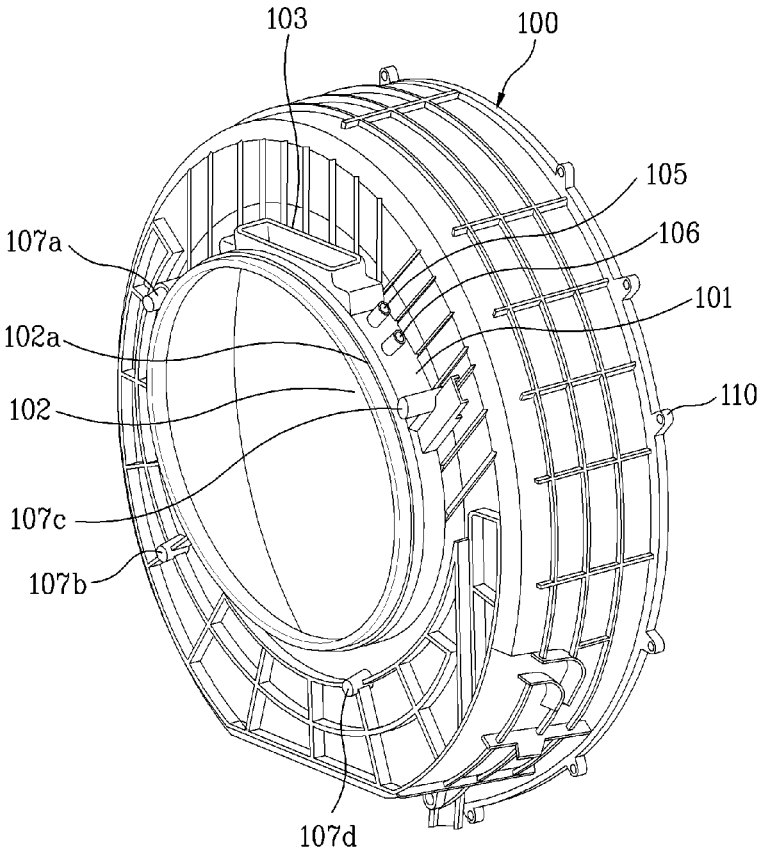

[Fig. 3]
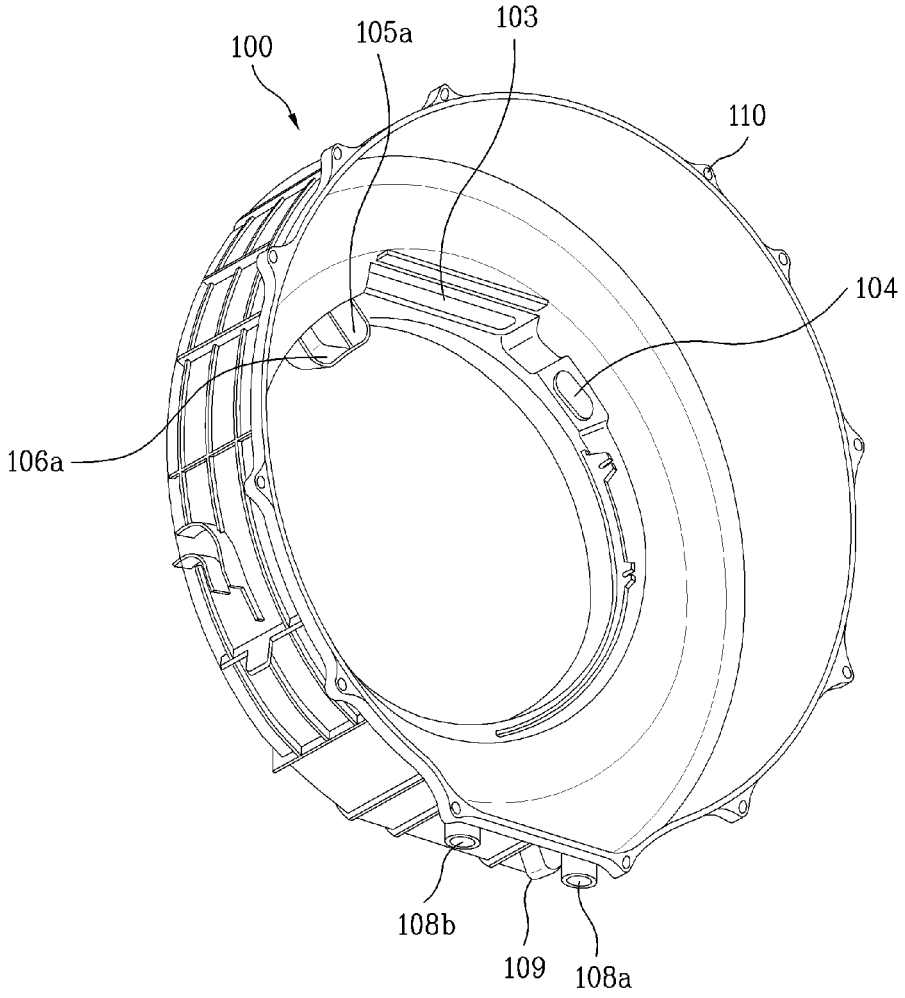

[Fig. 4]
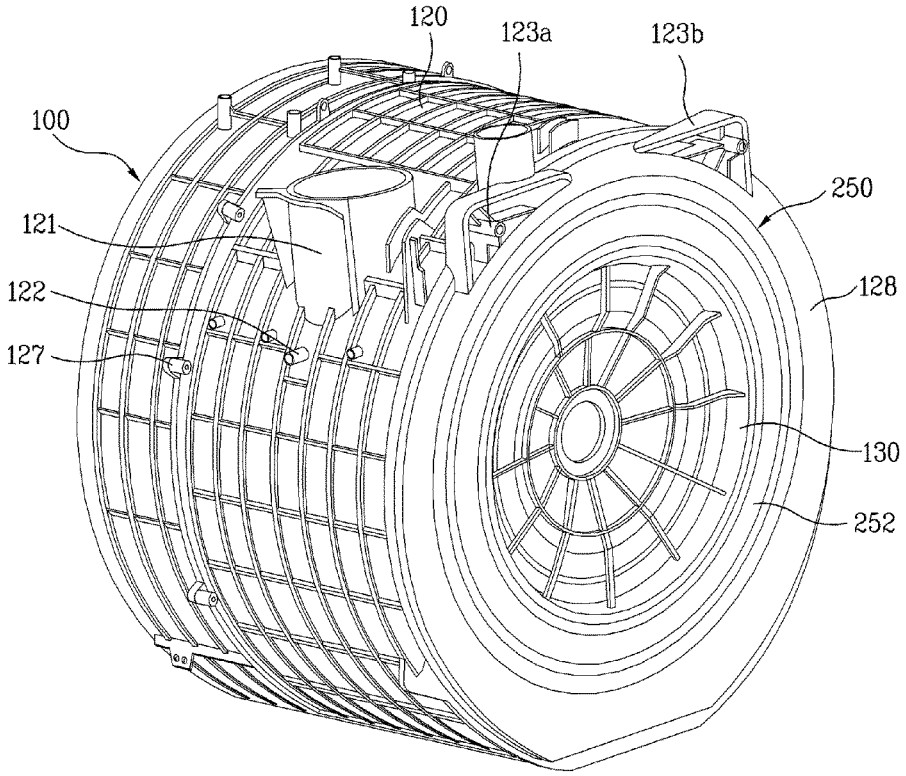
[Fig. 5]
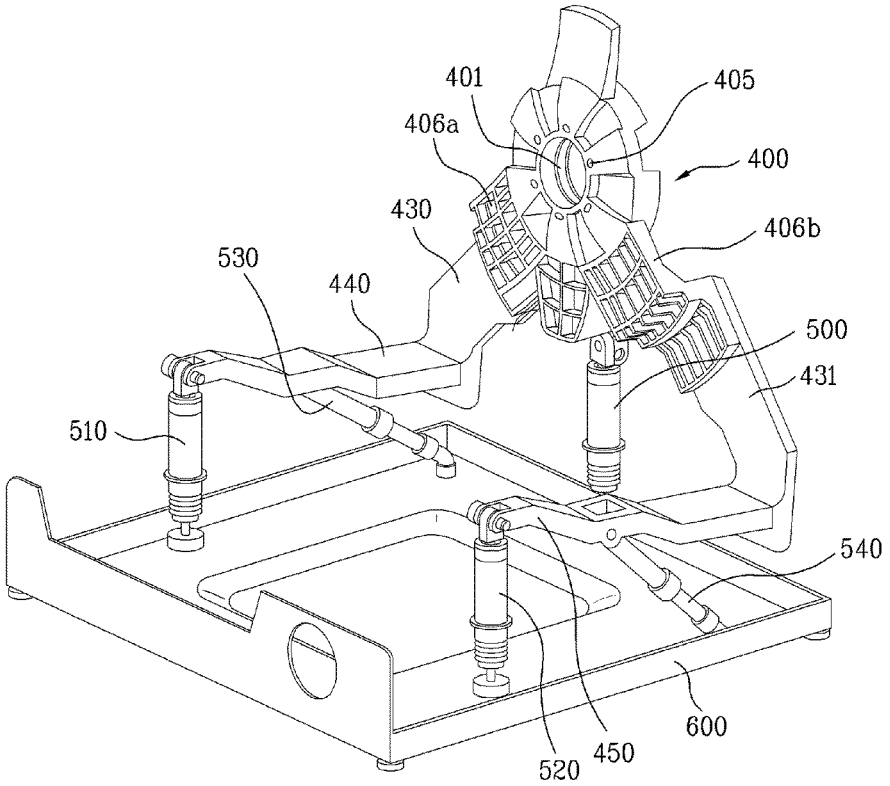

[Fig. 6]
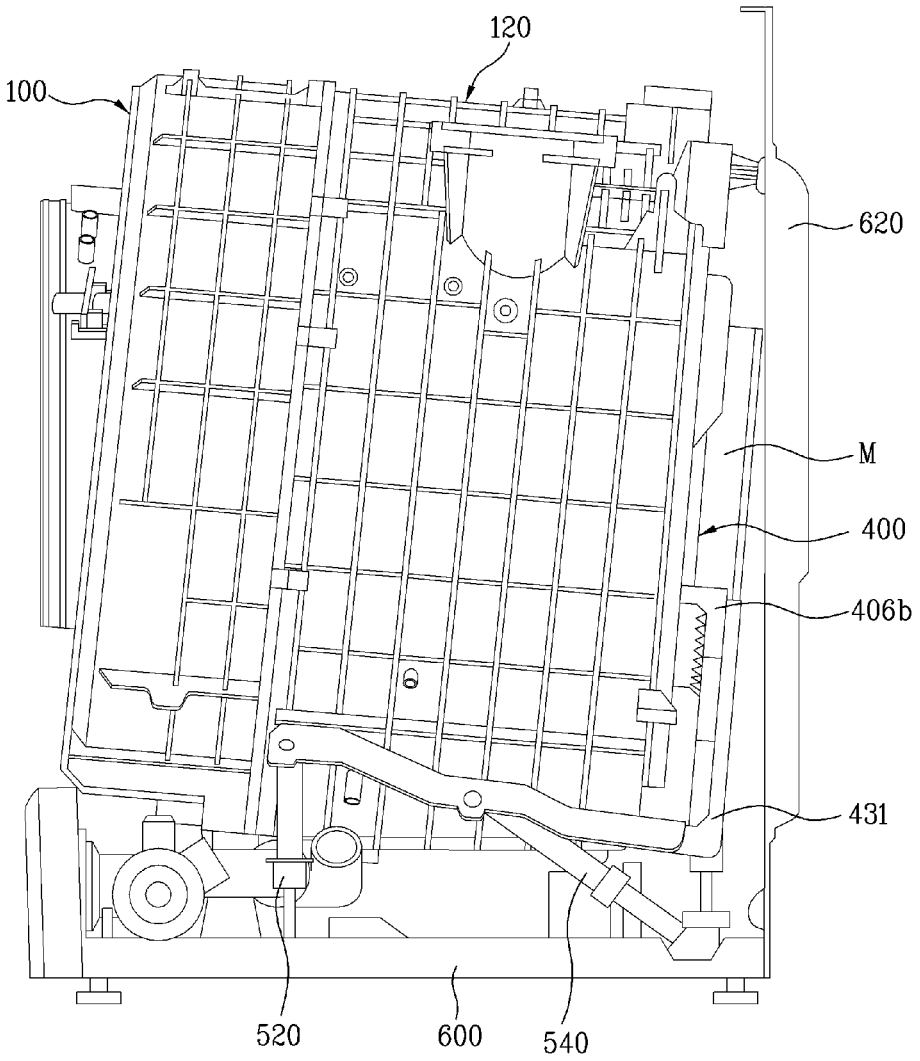

[Fig. 7]
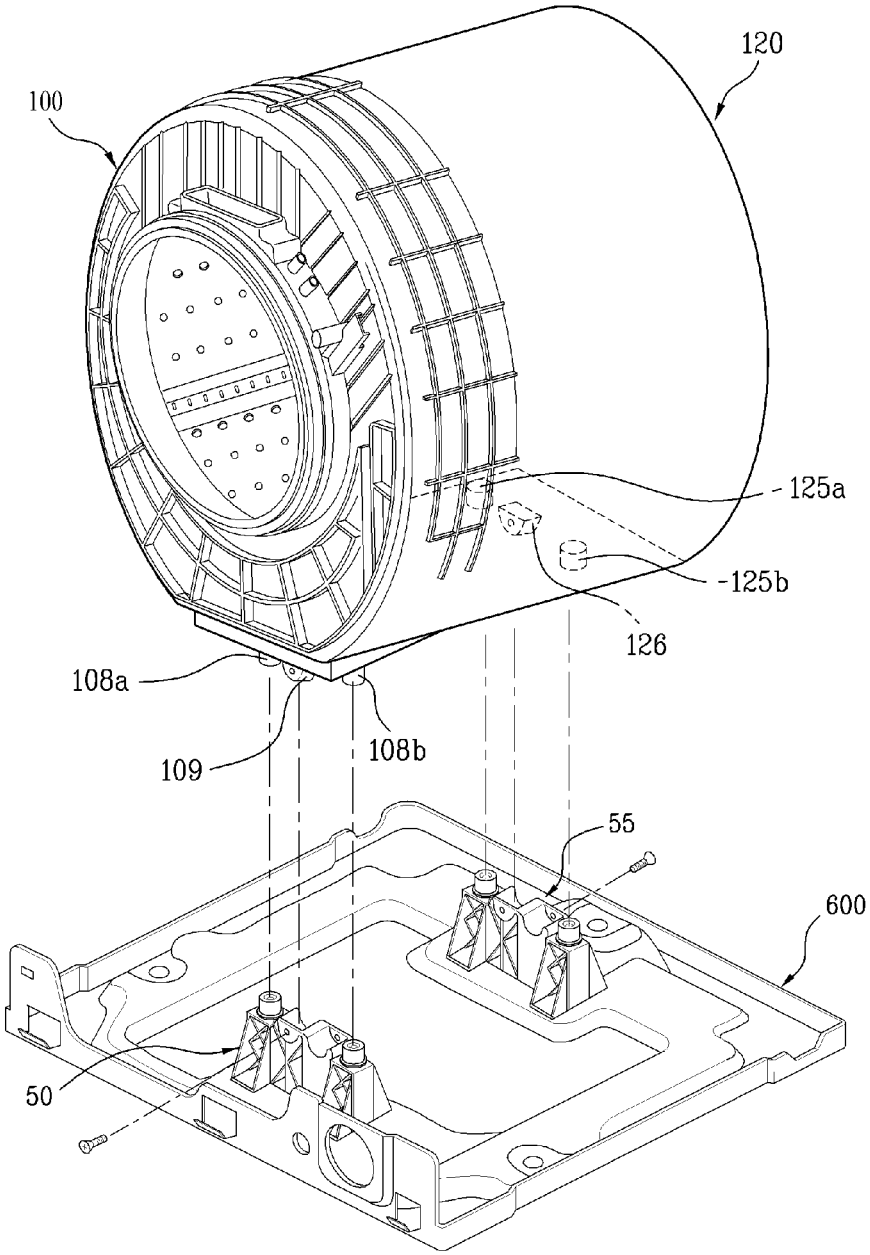

[Fig. 8]
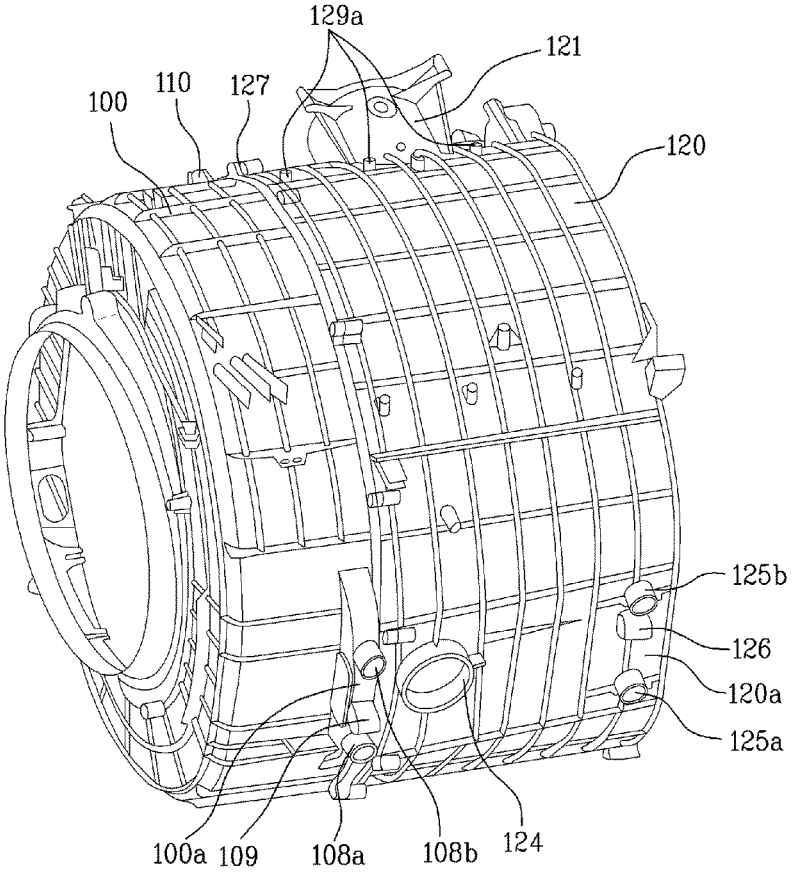
[Fig. 9]
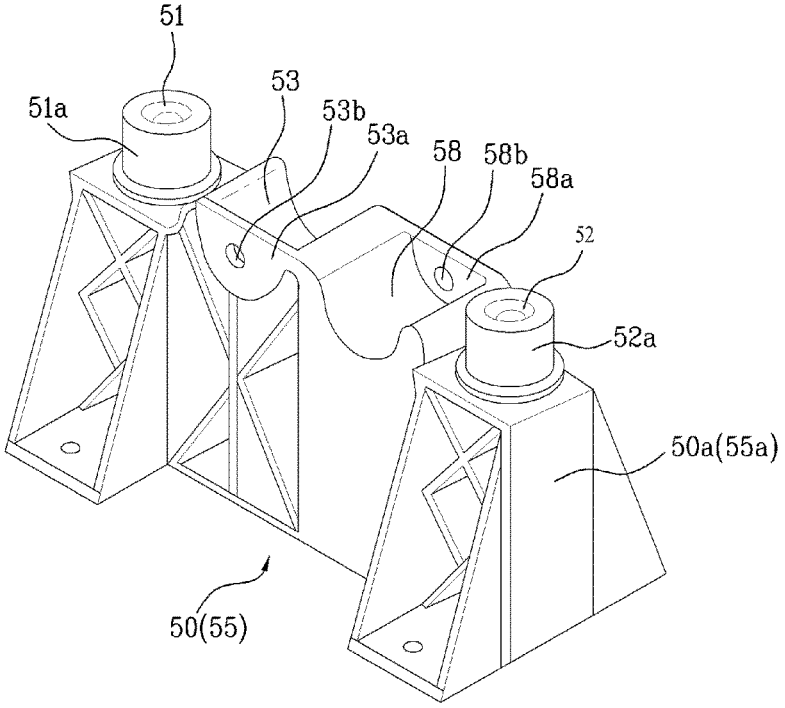

[Fig. 10]
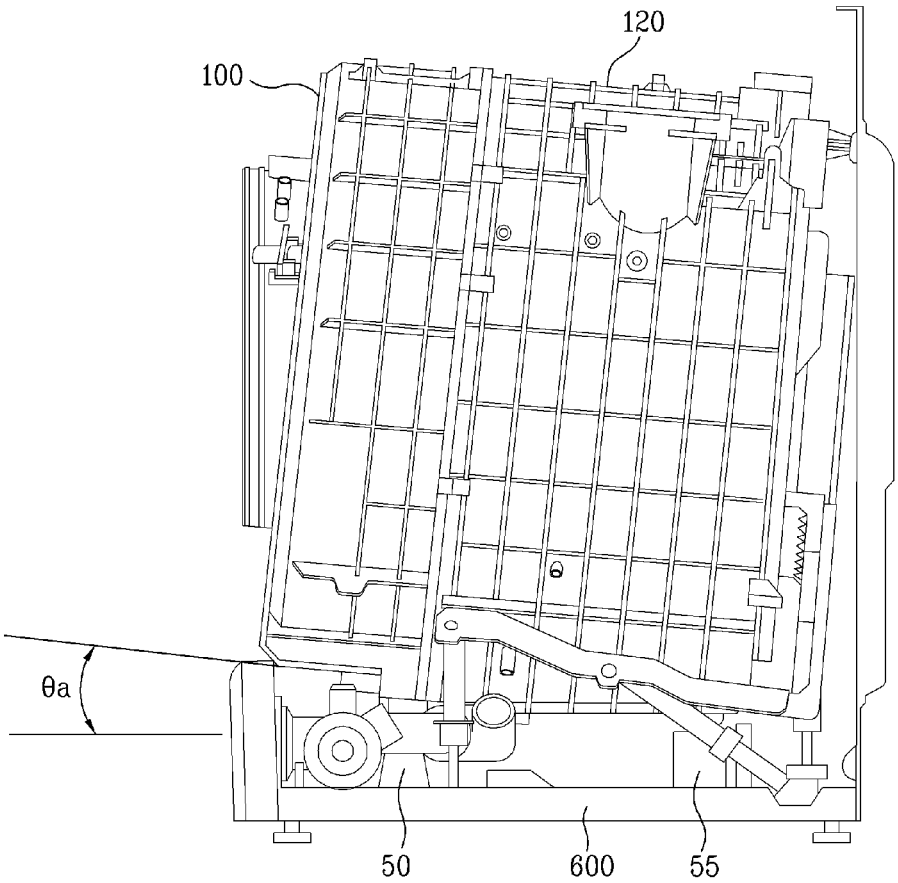
[Fig. 11]
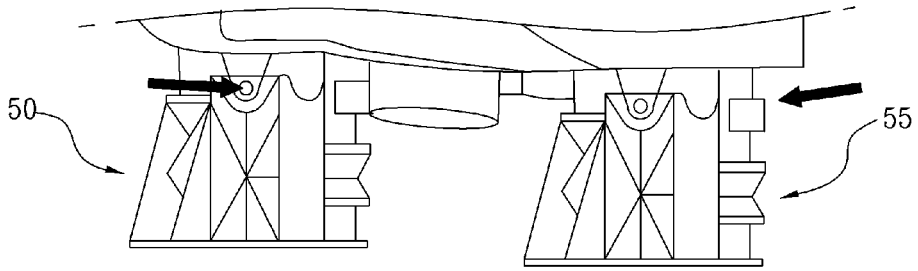

[Fig. 12]
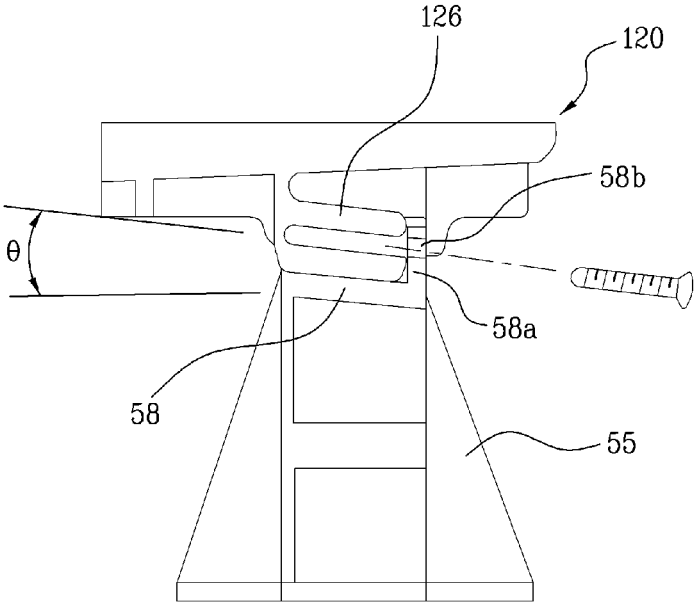

[Fig. 13]
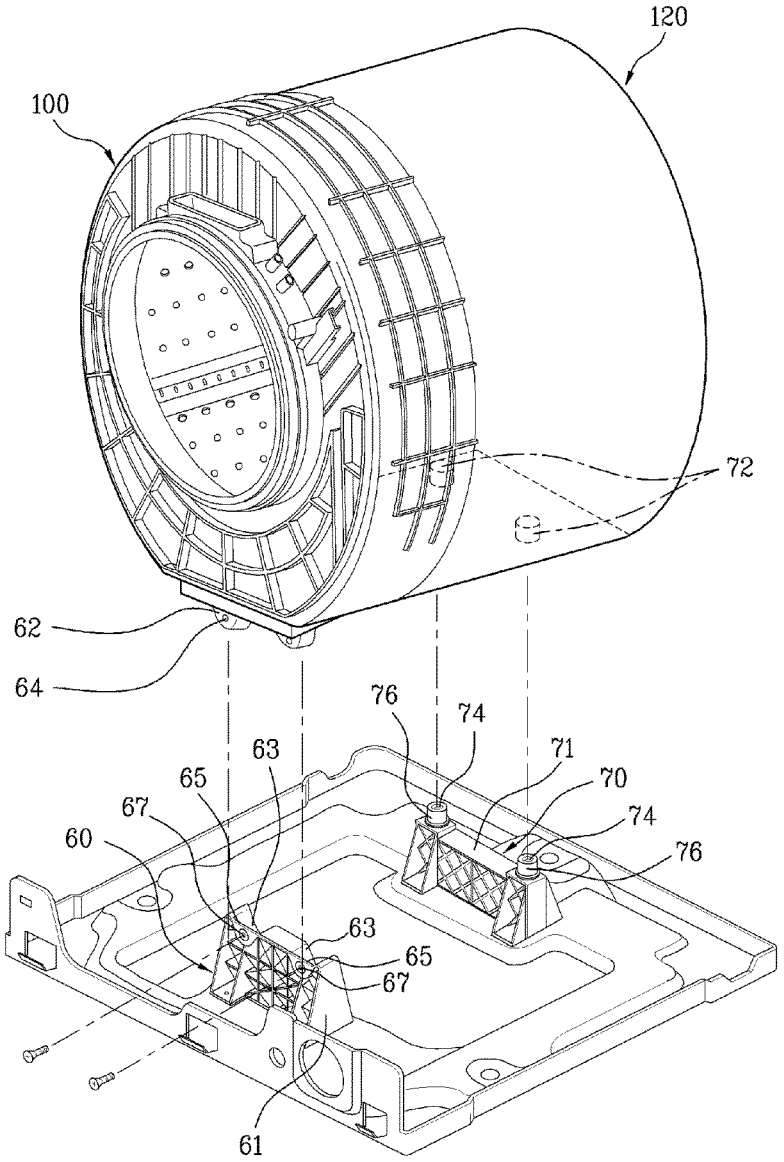
[Fig. 14]
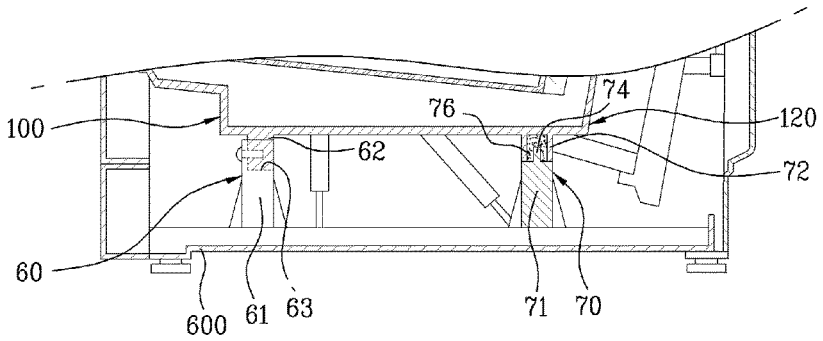

[Fig. 15]
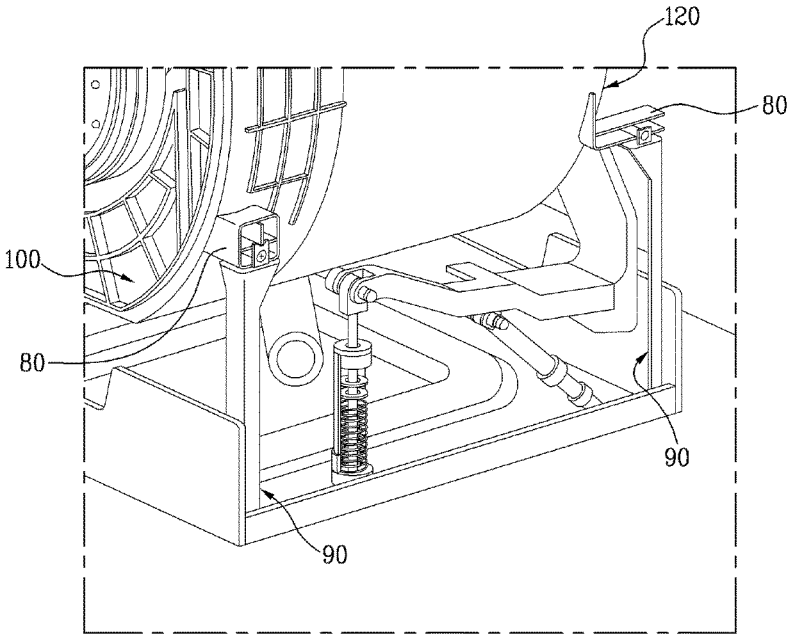
[Fig. 16]
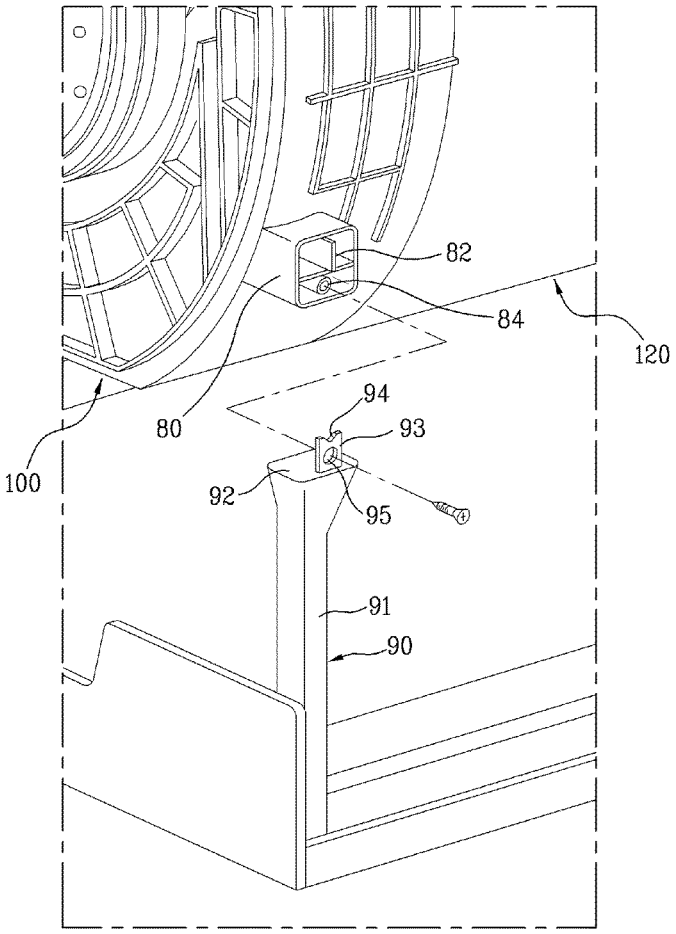

SUPPORTING STRUCTURE OF TUB FOR A LAUNDRY MACHINE

CROSS-REFERENCE TO RELATED PATENT APPLICATIONS

The application is a U.S. National Stage Application under 35 U.S.C. §371 of PCT Application No. PCT/KR2009/007957, filed Dec. 30, 2009, which claims priority to Korean Patent Application Nos. KR 10-2008-0136405and KR 10-2008-0136409, filed Dec. 30, 2008; KR 10-2009-0047192, filed May 28, 2009; KR 10-2009-079909 and KR 10-2009-079930, filed Aug. 27, 2009; and KR 10-2009-0134066, filed Dec. 30, 2009.

TECHNICAL FIELD

The present invention relates to a laundry machine, and more particularly, to a laundry machine capable of supporting, in a distributed manner, a vertical weight applied by a tub when the laundry machine has an increased washing capacity.

BACKGROUND ART

Generally, a laundry machine removes diverse contaminants attached to clothes and bedclothes, using an emulsification function of a detergent, friction and impact functions of water flows generated in accordance with a pulsator or a drum, etc. A full-automatic laundry machine, which has recently been developed, automatically performs a cycle including a washing course, a rinsing course, a spin-drying course, etc., without requiring an operation by a user in the middle of the cycle.

Recently, demand for drum type laundry machines has gradually increased. The drum type laundry machine can reduce the total height thereof, as compared to a pulsator type laundry machine, in which a washing tub rotates in an upright state. Also, in the drum type laundry machine, there is little or no problem of twisting of laundry and formation of a large amount of wrinkles in laundry.

Hereinafter, a structure of the above-mentioned drum type laundry machine will be briefly described. The drum type laundry machine is mainly divided into a body cabinet, which forms an outer appearance of the laundry machine, a tub arranged inside the body cabinet and supported by dampers and springs, to store wash water, and a cylindrical drum arranged inside the tub, to contain laundry. The drum receives a driving force from a driver, to wash the laundry loaded in the drum.

The drum type laundry machine having the above-mentioned structure inevitably generates vibration due to a rotating force of the drum, eccentricity of laundry loaded in the drum, etc. generated when the drum rotates to wash and spin-dry the laundry. The vibration generated during the rotation of the drum is outwardly transmitted via the tub and cabinet.

In order to prevent the vibration transmitted from the drum to the tub from being transmitted to the cabinet, springs and dampers are essentially provided between the tub and the cabinet to damp and reduce the vibration transmitted to the tub.

Meanwhile, in most cases, the above-mentioned drum type laundry machine is not installed in a separate state, but is installed in a state of being combined with the existing installation environment (for example, a sink environment or a built-in environment). To this end, the drum type laundry machine must have a limited size meeting the installation environment of the laundry machine.

Furthermore, in the above-mentioned drum type laundry machine, there is a limitation in varying the inner structure of the laundry machine due to the spring and damper structure provided to reduce vibration between the tub and the cabinet. Also, changing the size of the drum type laundry machine itself is limited because the installation environment of the laundry machine is limited.

Meanwhile, active research and development are being conducted to achieve an increase in the washing capacity of a laundry machine, and thus to achieve an increase in washing amount and an enhancement in user convenience. In the existing drum type laundry machine, however, there is considerable difficulty in increasing the size of the tub for an increase in washing capacity.

To this end, development of laundry machines having various structures capable of achieving an increase in washing capacity is required.

DISCLOSURE OF INVENTION

Technical Problem

The present invention has been made in view of the above-mentioned problems, and provides a laundry machine having a novel drum support structure completely different from those of conventional cases, in particular, capable of directly damping vibration generated from a drum while preventing the vibration from being transmitted to a tub.

The present invention has been made in view of the above-mentioned problems, and provides a laundry machine having an improved support structure capable of increasing the capacity of a tub while maintaining the same outer size as the outer size applied to conventional drum type laundry machines, and effectively supporting the capacity-increased tub.

Technical Solution

The object of the present invention can be achieved by providing a laundry machine including a cabinet to form an outer appearance, the cabinet comprising a base, a tub arranged in the cabinet, and a support unit provided at the base, to support a vertical weight of the tub.

The support unit may include a front supporter centrally installed at a front side of the base, to support a front side of the tub, and a rear supporter centrally installed at a rear side of the base, to support a rear side of the tub.

The tub may be formed with a front fitting protrusion downwardly protruded from a front lower portion of the tub. The front supporter may be formed with a front fitting groove, in which the front fitting protrusion is fitted.

The front fitting protrusion may have a wedge shape having an inverted triangular cross-section. The front fitting groove may have an inverted triangular shape corresponding to the shape of the front fitting protrusion.

A fastening hole may be formed at one side of the front fitting groove, to allow a fastener to extend through the fastening hole. A fastening groove may be formed at one side of the front fitting protrusion at a position corresponding to the fastening hole, to allow the fastener to be fastened into the fastening groove.

The tub may be formed with a rear fitting groove upwardly recessed from a rear lower portion of the tub. The rear supporter may be formed with a rear support protrusion to be fitted in the rear fitting groove.

The rear fitting groove may have a cylindrical shape. The rear support protrusion may be provided with a cylindrical support made of an elastic material. The cylindrical support may be fitted in the rear fitting groove, to support the tub.

The tub may be provided with a fitting protrusion and a fitting groove respectively formed at front and rear lower portions of the tub. The front supporter and the rear supporter may be provided with a fitting groove and a support protrusion to be coupled with the fitting protrusion and the fitting groove, respectively.

The fitting protrusion may have a wedge shape having an inverted triangular cross-section. The fitting groove may have an inverted triangular shape corresponding to the shape of the fitting protrusion.

A fastening hole may be formed at one side of the fitting groove, to allow a fastener to extend through the fastening hole. A fastening groove may be formed at one side of the fitting protrusion at a position corresponding to the fastening hole, to allow the fastener to be fastened into the fastening groove.

The fitting groove may have a cylindrical shape. The support protrusion may be provided with a cylindrical support made of an elastic material. The cylindrical support may be fitted in the fitting groove, to support the tub.

The laundry machine may further include a drum rotatably installed in the tub, a rotating shaft extending through the tub from a rear wall of the drum, a bearing housing connected to the rotating shaft, and a damper bracket for supporting the bearing housing in a damping manner with respect to the base.

In another aspect of the present invention, there is provided a laundry machine including a cabinet to form an outer appearance, the cabinet comprising a base, a tub fixedly mounted in the cabinet, a front supporter centrally installed at a front side of the base, to support a vertical weight of the tub while limiting a horizontal movement of the tub, and a rear supporter centrally installed at a rear side of the base, to support the vertical weight of the tub.

The laundry machine may further include a drum rotatably installed in the tub, a rotating shaft extending through the tub from a rear wall of the drum, a bearing housing connected to the rotating shaft, and a damper bracket for supporting the bearing housing in a damping manner with respect to the base.

In another aspect of the present invention, there is provided a laundry machine including a cabinet to form an outer appearance, the cabinet including a base, a tub fixedly mounted in the cabinet, a front supporter centrally installed at a front side of the base, to support a vertical weight of the tub while limiting a horizontal movement of the tub, and a rear supporter centrally installed at a rear side of the base, to support the vertical weight of the tub while limiting the horizontal movement of the tub, the rear supporter having the same shape as the front supporter.

The laundry machine may further include a drum rotatably installed in the tub, a rotating shaft extending through the tub from a rear wall of the drum, a bearing housing connected to the rotating shaft, and a damper bracket for supporting the bearing housing in a damping manner with respect to the base.

In another aspect of the present invention, there is provided a laundry machine including a cabinet to form an outer appearance, the cabinet including a base, a tub fixedly mounted in the cabinet, a drum rotatably installed in the tub, a rotating shaft extending through the tub from a rear wall of the drum, a bearing housing connected to the rotating shaft, a damper bracket for supporting the bearing housing in a damping manner with respect to the base, and a plurality of supporters installed at the base such that the supporters is arranged outside and beneath the tub, to support a vertical weight of the tub.

The cabinet may include a plurality of cabinet covers to surround an outer circumferential surface of the base. The supporters may be fixedly mounted to the base and respective inner surfaces of the cabinet covers.

A plurality of support ribs may be formed at a lower portion of an outer circumferential surface of the tub such that the support ribs are horizontally protruded. The supporters may support the support ribs, respectively.

An engagement protrusion may be formed at an end of each of the support ribs. An engagement groove may be formed at an end of each of the supporters, to receive the engagement protrusion of a corresponding one of the support ribs, thereby limiting a support position of the corresponding support rib.

Each of the supporters may be provided with a coupling rib formed at an end of the supporter, the coupling rib having a coupling hole. A fastening hole may be formed at an end of each of the support ribs, to allow a fastener to be fastened into the fastening hole after extending through the coupling hole of a corresponding one of the supporters.

The cabinet may include left and right panels and front and rear panels, which form the outer appearance. The supporters may be supported by corners defined by the panels while being in close contact with the corners, respectively.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made intergrally with the cabinet.

Next, the tub may be supported by being fastened by screws, ribets, rubber bushings, etc. Also, the tub may be welded or bonded to the cabinet. In this cases, the supporting or fastening members have larger stiffnesses than a stiffness of the suspension unit with respect to the main direction of the vibration of the drum.

The tub may be expanded within the limits of a space in which the tub is placed. That is, the tub may be expanded until the circumferential surface thereof reaches (or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made intergally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the drum in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprises at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object (for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back (which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure. However, even in this case, a front plate forming the front face of the laundry machine may be required.

Advantageous Effects

In accordance with the laundry machine of the present invention, it is possible to provide a drum washing machine having a novel drum support structure completely different from those of conventional cases. Vibration generated from a drum is effectively damped without being transmitted to a tub.

In accordance with the laundry machine of the present invention, it is possible to increase the capacity of a tub by varying the structure of the laundry machine, and to enhance the support stability of the capacity-increased tub by vertically supporting the weight of the tub.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is an exploded perspective view illustrating a laundry machine according to the present invention;

FIGS. 2 and 3 are perspective views illustrating a tub front of the laundry machine according to the present invention;

FIG. 4 is a rear perspective view illustrating a tub rate of the laundry machine according to the present invention;

FIG. 5 is a perspective view illustrating a suspension unit of the laundry machine according to the present invention;

FIG. 6 is a side view illustrating a coupled state of the tub and suspension unit in the laundry machine according to the present invention;

FIG. 7 is an exploded perspective view illustrating a support state of a laundry machine according to a first embodiment of the present invention;

FIG. 8 is a bottom perspective view illustrating a tub of the laundry machine according to the present invention;

FIG. 9 is an enlarged perspective view illustrating a support of the laundry machine according to the first embodiment of the present invention;

FIG. 10 is a side view illustrating a support state of the laundry machine according to the first embodiment of the present invention;

FIG. 11 is an enlarged sectional perspective view illustrating a support state of the laundry machine according to the first embodiment of the present invention;

FIG. 12 is a sectional view illustrating a support state of the laundry machine according to the first embodiment of the present invention;

FIG. 13 is a perspective view illustrating a laundry machine according to a second embodiment of the present invention.

FIG. 14 is a sectional view illustrating the laundry machine according to the second embodiment of the present invention;

FIG. 15 is a perspective view illustrating a laundry machine according to a third embodiment of the present invention; and FIG. 16 is an exploded perspective view illustrating a coupled state of the laundry machine according to the third embodiment of the present invention.

BEST MODE FOR CARRYING OUT THE INVENTION

Hereinafter, a laundry machine according to an exemplary embodiment of the present invention will be described with reference to the accompanying drawings.

In the following description, the name of each constituent element in the present invention is defined, taking into consideration the function of the constituent element. Therefore, the technical meaning of each constituent element should not be limited to the name of each constituent element. In the present technical field, each constituent element may also be designated by a name other than the name defined in this description.

FIG. 1 is an exploded perspective view illustrating a laundry machine according to the present invention.

In the illustrated laundry machine, a tub is fixedly mounted to a cabinet.

The tub includes a tub front 100, which forms a front section of the tub, and a tub rear 120, which forms a rear section of the tub. The tub front 100 and tub rear 120 are assembled by screws. The assembled tub front 100 and tub rear 120 define therein a space to receive a drum. The tub also includes a tub back 130, which forms a rear wall of the tub. The tub back 130 is connected to the tub rear 120 via a rear gasket 250. The rear gasket 250 is made of a flexible material, in order to prevent vibration generated at the tub back 130 from being transmitted to the tub rear 120.

The tub rear 120 has a rear wall 128. The rear wall 128 of the tub rear 120 constitutes the rear wall of the tub, together with the tub back 130 and rear gasket 250. The rear gasket 250 is sealably connected between the tub back 130 and the tub rear 120, to prevent wash water in the tub from leaking. The tub back 130 is vibrated, together with the drum, during rotation of the drum. For this reason, the tub back 130 is sufficiently spaced from the tub rear 120, in order to prevent the tub back 130 from interfering with the tub rear 120 during rotation of the drum. The rear gasket 250 is made of a flexible material. Accordingly, the rear gasket 250 allows the tub back 130 to move relative to the tub rear 120 without interfering with the tub rear 120. The rear gasket 250 may have a bellows portion 252 (FIG. 4) extendable to a sufficient length to allow the relative movement of the tub back 130.

A foreign matter cutoff member 200 is connected to a front portion of the tub front 100, in order to prevent foreign matter from being caught between the tub and the drum. The foreign matter cutoff member 200 is made of a flexible material, and is fixedly mounted to the tub front 100. The foreign matter cutoff member 200 may be made of the same material as the rear gasket 250.

The drum includes a drum front 300, a drum center 320, and a drum back 340. Ball balancers 310 and 330 are installed at front and rear sides of the drum. A spider 350 is connected to the drum back 340. The spider 350 is connected to a rotating shaft 351. The drum is rotated within the tub by a rotating force transmitted to the drum via the rotating shaft 351.

The rotating shaft 351 extends through the tub back 130, and is directly connected to a motor. In detail, the rotating shaft 351 is directly connected to a rotor of the motor. A bearing housing 400 is coupled to a rear wall 128 of the tub back 130. The bearing housing 400 rotatably supports the rotating shaft 351 between the motor and the tub back 130.

A stator is fixedly installed in the bearing housing 400. The rotor is arranged to surround the stator. As described above, the rotor is directly connected with the rotating shaft 351. The motor is of an outer rotor type, so that it is directly connected with the rotating shaft 351.

The bearing housing 400 is supported by a cabinet base 600 via a suspension unit. The suspension unit includes three vertical supports and two slant supports to support the bearing housing 400 in a direction that is slanted with respect to a front-to-rear direction. The suspension unit is connected to the cabinet base 600 without being completely fixed to the cabinet base 600. That is, the suspension unit is connected to the cabinet base 600 in a state of being allowed to be elastically deformed, thereby allowing the drum to move in front-to-rear and left-to-right directions. That is, the suspension unit is elastically supported to be pivotable within a certain angle in the front-to-rear and left-to-right directions about each support point thereof, at which the suspension unit is connected to the cabinet base 600. For such elastic support, the vertical supports of the suspension unit may be installed on the base 600 via rubber bushings. The vertical supports of the suspension unit, which are vertically installed, function to elastically damp the vibration of the drum, whereas the slant supports of the suspension unit, which are slantingly installed, function to attenuate the vibration of the drum. In this connection, in a vibrating system including a spring and a damping means, the suspension unit may be configured such that the vertical supports function as the spring, and the slant supports function as the damping means.

The tub, except for the tub back 130 thereof, is fixedly mounted to the cabinet. The vibration of the drum is damped by the suspension unit. Practically, the support structures for the tub and drum may be considered separate structures. Also, the support structures may be considered as being configured to prevent the tub from being vibrated even when the drum vibrates.

Hereinafter, the laundry machine will be described in more detail in conjunction with each part thereof.

FIGS. 2 and 3 illustrate the tub front 100. The tub front 100 includes a cylindrical wall constituting a portion of a side wall of the tub, and a donut-shaped vertical front wall formed at a front end of the cylindrical wall. The tub front 100 also has an open rear end. At the rear end, the tub front 100 has a plurality of fastening holes 110. The fastening holes 110 are aligned with corresponding fastening holes 127 (FIG. 4) of the tub rear 120, to fasten the tub front 100 and tub rear 120.

A rim 101 extends forwardly from an inner circumference of the front wall of the tub front 100. The rim 101 has a width gradually reduced as the rim 101 extends from the top thereof to the bottom thereof. Practically, the rim 101 need not be formed at the bottom of the inner circumference of the front wall of the tub front 100.

The rim 101 is formed with a water supply port 104 for supplying wash water, a hot air inlet 103 to be used in a drying operation, a circulating water inlet 106, into which wash water circulated by a circulation pump is introduced, a steam port 105, into which steam is introduced, etc.

In the laundry machine according to the present invention, it is possible to stably support connections for a water supply structure such as a water supply hose, a drying structure such as a drying duct, a steam supply structure, a circulating water supply structure, etc. because vibration applied to the tub is considerably reduced in the laundry machine.

The hot air inlet 103 extends upwardly from the rim 101 and has a substantially rectangular cross-section. The hot air inlet 103 is needed in the case of a washing machine having a drying function. The hot air inlet 103 need not be formed in the case of a washing machine having no drying function.

Since the water supply port 104, etc. are formed at the front side of the tub front 100, as described above, the supply of wash water, etc. is carried out at the front side of the tub.

The water supply port 104, etc. may be arranged forwardly of the front end of the drum received in the tub. In this case, accordingly, the wash water, etc. may be directly introduced into the drum through a drum opening provided to allow loading and unloading of laundry. In this case, it is possible to more effectively treat laundry because fluids supplied to treat the laundry, namely, the wash water, etc., can be directly introduced into the drum. Where a detergent is supplied from a detergent box when the wash water is supplied, it is possible to reduce the amount of the detergent that is used, if the detergent can be directly introduced into the drum. In this case, it is also possible to reduce the amount of the wash water that is used. Also, it is possible to reduce a problem of contamination caused by detergent sediments accumulated on the bottom of the tub. In addition, there may be an effect of cleaning a door glass (not shown) by wash water when the wash water is supplied from the front side of the tub.

Even when hot air is supplied from the front side of the tub, the supply of the hot air may be ineffectively carried out in the case in which the hot air is supplied through the vertical wall of the tub front 100. This is because the path, along which the hot air flows, has a complex 90°-rotated U-shaped structure having two bent portions (In this case, the hot air flows from the rear side of the tub to the front side of the tub, flows downwardly at the front side of the tub along one bent portion of the path, and then flows to the vertical wall of the tub along the other bent portion of the path.) However, where the hot air inlet 103 is formed at the rim 101 of the tub front 100, the path, along which the hot air flows, has a single bent portion, so that the hot air can smoothly flow.

The water supply port 104, etc. are arranged above the center of the drum. The wash water, etc. are supplied to the interior of the drum through an upper portion of the drum at the front side of the drum. If it is necessary to supply the wash water, etc. to the interior of the drum through a lower portion of the drum at the front side of the drum, different from the above-described case, the rim 101 of the tub front 100 may be formed at the bottom of the front wall of the tub front 100. Also, if it is necessary to supply the wash water, etc. in a lateral direction, different from the above-described case, in which the wash water, etc. are supplied in a vertical direction, the rim 101 may be formed in the vicinity of a central portion 131 of the front wall of the tub front 100. That is, the structure of the rim 101 may be varied in accordance with the supply direction of fluids to be supplied.

A coupler 102 is formed at a front end of the rim 101, to couple the foreign matter cutoff member 200. The coupler 102 extends forwardly from the front end of the rim 101 such that the coupler 102 has a substantially cylindrical structure having a small size. A rib 102*a* is formed on an outer circumferential surface of the coupler 102.

The coupling of the foreign matter cutoff member 200 to the coupler 102 is achieved as the coupler 102 is fitted into the foreign matter cutoff member 200. To this end, the foreign matter cutoff member 200 is formed with a fitting groove (not shown), with which the rib 102*a* formed at the small cylindrical surface of the coupler 102 is engagable.

The tub front 100 is fixedly connected to a cabinet front (not shown). For this fixed connection, clamping bosses 107*a*, 107*b*, 107*c*, and 107*d* are formed at the front wall of the tub front 100 around the rim 101. A cabinet front (not shown) is arranged at a desired position under the condition that the tub front 100 is installed, and is then fastened to the tub front 100 by fastening screws in a front-to-rear direction.

FIG. 3 is a view showing the interior of the tub front 100 at the rear side.

The steam port 105 may be connected to a steam hose. A steam guide 105*a* is provided to guide steam emerging from the steam port 105 toward the inside of the drum. A circulating water guide 106*a* is also provided to guide circulating water emerging from the circulating water inlet 106 toward the inside of the drum. The steam port 105, circulating water inlet 106, steam guide 105*a*, circulating water guide 106*a*, etc. are integrally formed at the tub front 100. The tub front 100 is formed through a plastic injection molding process. At this time, the steam port 105, etc. are injection-molded together with the tub front 100, as a part of the tub front 100.

The tub front 100 is coupled with the tub rear 120, thereby forming a space to receive the drum. The tub front 100 and tub rear 120 are fastened to each other by screws. For this screw fastening, a plurality of screw fastening holes 110 is formed along a circumference of the tub front 100 at the rear end of the tub front 100.

FIGS. 4 and 5 show a coupled state of the tub front 100, tub rear 120, tub back 130, and rear gasket 250.

The tub rear 120 has a cylindrical structure to surround the drum. The tub rear 120 has a front portion having an open front end, and a rear portion having a donut-shaped rear wall 128. The front portion of the tub rear 120 is sealably coupled to the tub front 100. The rear wall 128 of the tub rear 120 has an inner diameter sufficiently greater than the outer diameter of the tub back 130. Accordingly, the rear wall 128 of the tub rear 120 is spaced apart from the tub back 130 by a sufficient spacing to prevent the tub back 130 from interfering with the rear wall 128 even when the tub back 130 vibrates. The rear gasket 250 is arranged in the spacing. That is, the rear gasket 250 is connected between the rear wall 128 of the tub rear 120 and the tub back 130. The rear gasket 250 provides a sealing effect between the rear wall 128 of the tub rear 120 and the tub back 130. The rear gasket 250 may have a bellows portion being sufficiently flexible to prevent the rear gasket 250 from interfering with vibration of the tub back 130.

A hot air outlet 121 is formed at one side of the tub rear 120, for a drying function of the laundry machine. Where the laundry machine only has a washing function without having a drying function, the hot air outlet 121 need not be provided.

Meanwhile, separate structures are additionally formed beneath the tub front 100 and tub rear 120, in order to firmly support the tub with respect to the base. The support structures for the tub front 100 and tub rear 120 will be described in detail later in conjunction with a tub support structure.

FIG. 6 shows a state in which the suspension unit is mounted on the base 600. FIG. 7 shows a coupled state of the tub, namely, the tub front 100 and tub rear 120, bearing housing 400, and suspension unit.

The suspension unit includes the bearing housing 400, a first weight 431, a second weight 430, a first suspension bracket 450, and a second suspension bracket 440.

The bearing housing 400 includes a bearing support 401 for supporting bearings. Tub back coupling holes 405 are formed at a front portion of the bearing housing 400, to mount the bearing housing 400 to the tub back 250. A motor mounting portion (not shown) is formed at a rear portion of the bearing housing 400, to mount the motor to the bearing housing 400.

First and second extensions 406*a* and 406*b* extend laterally in opposite radial directions from the bearing housing 400, respectively. The first and second weights 431 and 430 are connected to the first and second extensions 406*a* and 406*b*, respectively. First and second suspension brackets 450 and 440 are connected to the first and second weights 431 and 430, respectively.

Here, each of the first extension 406*a*, first weight 406*b*, and first suspension bracket 450 is symmetrically formed with a corresponding one of the second extension 440, second weight 406*a*, and second suspension bracket 440. The first and second weights 431 and 430 function to balance weight when laundry is received in the drum. The first and second weights 431 and 430 also function as a mass in a vibration system of the drum.

The suspension unit may include vertical suspensions for vertically damping vibration, and front-to-rear suspensions for damping vibration in a front-to-rear direction. The vertical suspensions may be arranged such that one suspension is arranged at the rear side, and two suspensions are arranged at the front side while being laterally opposite with respect to the center of the base. The front-to-rear suspensions may be arranged to be laterally opposite while being inclined in a front-to-rear direction.

The suspension unit may include a first cylinder spring 520, a second cylinder spring 510, a third cylinder spring 500, a first cylinder damper 540, and a second cylinder damper 530.

A cylinder spring has a structure in which a spring is installed between a cylinder and a piston. Since the cylinder spring has a cylinder-piston structure, its length is stably varied during a damping operation. The cylinder is connected to a suspension bracket, whereas the piston is connected to the side of a base. On the other hand, a cylinder damper has a structure in which a piston moves within a cylinder, to obtain a damping effect in accordance with frictional resistance generated during the movement of the piston.

The first cylinder spring 520 is connected between the first suspension bracket 450 and the base 600. The second cylinder spring 510 is connected between the second suspension bracket 440 and the base 600. The third cylinder spring 500 is directly connected between the bearing housing 400 and the base 600. Thus, damping support structures are provided at one position at the rear side and two laterally-opposite positions at the front side by the cylinder springs.

The first cylinder damper 540 is slantingly installed between the first suspension bracket 450 and a rear portion of the base 600. The second cylinder damper 530 is slantingly installed between the second suspension bracket 440 and the base rear portion.

The third cylinder spring 500 is centrally arranged at the rear side, whereas the first and second cylinder springs 520 and 510 are arranged at the front side while being laterally opposite. Each of the first cylinder damper 540 and second cylinder damper 530 is arranged between the rear position where the third cylinder spring 500 is arranged and an associated one of the front positions where the first and second cylinder springs 520 and 510 are arranged, respectively. The first and second cylinder dampers 540 and 530 are laterally symmetrical. The cylinder springs are connected to the base 600 via rubber bushings.

Hereinafter, a tub support structure of the laundry machine according to a first embodiment of the present invention will be described with reference to FIGS. 7 to 12.

FIG. 7 is an exploded perspective view illustrating a support state of the laundry machine according to the first embodiment of the present invention. FIG. 8 is a bottom perspective view illustrating the tub of the laundry machine according to the present invention. FIG. 9 is an enlarged perspective view illustrating a support of the laundry machine according to the first embodiment of the present invention.

The tub support structure according to the first embodiment of the present invention includes a tub support front 50 and a tub support rear 55, which have the same structure. The tub support front 50 and tub support rear 55 support the tub front 100 and tub rear 120, respectively. The tub support front 50 and tub support rear 55 are fixedly mounted to the base 600 at front and rear central portions of the base 600 by separate couplers (for example, screw bolts (not shown)), respectively.

The tub support front 50 and tub support rear 55 will be described only in conjunction with the tub support front 50, without being individually described. The tub support rear 55 will be described only for different portions thereof from the tub support front 50 in terms of mounting structure.

Meanwhile, the tub front 100 and tub rear 120 may have flat portions 100*a* and 120*a* at lower portions thereof, respectively. Although the outer surfaces of the tub front 100 and tub rear 120 are substantially curved, the flat portions 100*a* and 120*a* have flat surfaces, respectively.

Where the tub is installed in a tilted state, each of the flat portions 100*a* and 120*a* is slantingly formed such that a front part thereof is higher than a rear part thereof. That is, although the tub is tilted, the bottom surface of the tub is horizontally maintained such that the front and rear portions thereof have the same height with respect to the base 100. Accordingly, the tub support front 50 and tub support rear 55 can have the same shape.

A fitting protrusion 109 and fitting grooves 108*a* and 108*b* are formed at the flat portion 100*a* provided at the lower portion of the tub front 100. The fitting protrusion 109 and fitting grooves 108*a* and 108*b* are coupled to the tub support front 50, to make the tub front 100 be supported by the tub support front 50. Also, a fitting protrusion 126 and fitting grooves 125*a* and 125*b* are formed at the flat portion 120*a* provided at the lower portion of the tub rear 120. The fitting protrusion 126 and fitting grooves 125*a* and 125*b* are coupled to the tub support rear 55, to make the tub rear 120 be supported by the tub support rear 55.

Each of the fitting protrusions 109 and 126 has a wedge shape having an inverted triangular cross-section. A fastening groove is formed through each of the fitting protrusions 109 and 126 in a direction parallel to the tilted axial direction of the tub. A fastener such as a bolt or a screw is fastened into the fastening groove. The fitting protrusions 109 and 126 formed at the tub front 100 and tub rear 120 are arranged at positions, which are not aligned with each other.

The fitting grooves 108*a* and 108*b* formed at the tub front 100 are arranged at opposite sides of the fitting protrusion 109 of the tub front 100, respectively. The fitting grooves 125*a* and 125*b* formed at the tub rear 200 are arranged at opposite sides of the fitting protrusion 126 of the tub rear 120, respectively. Each of the fitting grooves 108*a*, 108*b*, 125*a*, and 125*b* has a cylindrical shape so that it receives a corresponding one of support protrusions 51 and 52 of the tub support front 50 and tub support rear 55.

The tub support front 50 includes a supporter body 50*a* to form a support height for the tub. A support groove 53 is centrally formed at an upper portion of the supporter body 50*a*. The fitting protrusion 109 is fitted in the support groove 53. At one side of the support groove 53, another support groove 58 is formed. The support groove 58 receives the fitting protrusion 126 of the tub rear 120 when the tub support front 50 is used as the tub support rear 55. The support protrusions 51 and 52, which will be fitted in the fitting grooves 108*a* and 108*b* of the tub front 100, are arranged at opposite sides of the support grooves 53 and 58, respectively. In the tub support rear 55, the support protrusions 51 and 52 will be fitted in the fitting grooves 125*a* and 125*b*.

Each of the support grooves 53 and 58 has an inverted triangular shape corresponding to the shape of the fitting protrusions 109 and 126. Each of the support grooves 53 and 58 may have a slot shape having an inverted triangular cross-section. Where the support grooves 53 and 58 have a slot shape, the fitting protrusions 109 and 126 of the tub front 100 and tub rear 120 may be fitted in the support grooves 53 and 58 while having an installation clearance in a forward/rearward direction.

To this end, where the support grooves 53 and 58 have a slot shape, stoppers 53*b* and 58*b* are formed at front ends (or rear ends) of the support grooves 53 and 58, to limit movement of the fitting protrusions 109 and 126, respectively. Fastening holes 53*c* and 58*c* are formed through the stoppers 53*b* and 58*b*, respectively. Separate fasteners are fastened into the fastening holes 53*c* and 58*c*, respectively.

The support protrusions 51 and 52 have a circular column shape so that they are fitted into the fitting grooves 108*a* and 108*b* of the tub front 100 or into the fitting grooves 125*a* and 125*b* of the tub rear 120, respectively. Rubber bushings 51*a* and 52*a* having certain elasticity are fitted around outer circumferential surfaces of the support protrusions 51 and 52, respectively. By virtue of the elasticity of the rubber bushings 51*a* and 52*a* fitted around the support protrusions 51 and 52, it is possible to offset an installation clearance caused by a dimensional error formed when the tub front 100 and tub rear 120 are installed.

Meanwhile, the fitting protrusion 109 of the tub front 100 is fitted in a left one of the support grooves 53 and 58 of the tub support front 50, namely, the support groove 53. A screw is fastened into the fastening hole 53*b* formed through the stopper 53*a*, and then into the fastening groove of the fitting protrusion 109. In this case, the fastening direction of the screw corresponds to a front-to-rear direction of the tub.

The fitting protrusion 126 of the tub rear 120 is fitted in a right one of the support grooves 53 and 58 of the tub support rear 55, namely, the support groove 58. A screw is fastened into the fastening hole 58*b* formed through the stopper 58*a*, and then into the fastening groove of the fitting protrusion 126. In this case, the fastening direction of the screw corresponds to a rear-to-front direction of the tub.

The fitting protrusion 109 of the tub front 100 and the fitting protrusion 126 of the tub rear 120 are arranged such that they are not aligned with each other in a front-to-rear direction. The fitting protrusion 109 of the tub front 100 may be arranged at the left side, whereas the fitting protrusion 126 of the tub rear 120 may be arranged at the right side.

A part of the outer circumferential surface of the tub rear 120 is firmly supported by the support protrusions 51 and 52 of the tub support rear 55. A part of the outer circumferential surface of the tub front 100 is firmly supported by the support protrusions 51 and 52 of the tub support front 50. Accordingly, the tub support front 50 and tub support rear 55 function as fixing bases against vibration of the outer circumferential surface of the tub. As a result, it is possible to reduce the vibration of the outer circumferential surface of the tub, and to reduce aerodynamic noise. Since the drum moves within the tub, the tub is subjected to severe pressure variation. For this reason, the outer circumferential surface of the tub vibrates, thereby generating aerodynamic noise. The fasteners contribute to reduce such vibration and aerodynamic noise.

The fitting protrusions 109 and 126 of the tub front 100 and tub rear 120, and the support grooves 53 and 58 of the tub support front 50 and tub support rear 55 are slantingly formed to be parallel to the tilting direction of the tub. The fastening grooves formed through the fitting protrusions 109 and 126 of the tub front 100 and tub rear 120 are also slantingly formed to be parallel to the tilting direction of the tub.

Hereinafter, coupling of the tub support structure according to the first embodiment of the present invention will be described.

The tub support front 50 and tub support rear 55 are centrally installed at the front and rear sides of the base 600, respectively, to support a weight applied by the tub. In this case, the fitting protrusions 109 and 126 formed at the tub front 100 and tub rear 120 are fitted in the support groove 53 of the tub support front 50 and the support groove 58 of the tub support rear 55, respectively.

Movement of the fitting protrusions 109 and 126 fitted in the support grooves 53 and 58 is limited by the stoppers 53*a* and 58*a*. The fitting protrusions 109 and 126 fitted in the support grooves 53 and 58 are fixed by fasteners fastened through the fastening holes 53*b* and 58*b* of the stoppers 53*a* and 58*a*, respectively. The support protrusions 51 and 52 of the tub support front 50 and tub support rear 55 are fitted in the fitting grooves 108*a*, 108*b*, 125*a*, and 125*b* of the tub front 100 and tub rear 120, respectively. Movement of the support protrusions 51 and 52 of the tub support front 50 and tub support rear 55 fitted in the fitting grooves 108*a*, 108*b*, 125*a*, and 125*b* is limited by the fitting grooves 108*a*, 108*b*, 125*a*, and 125*b*.

The support protrusions 51 and 52 may be fitted in the fitting grooves 108*a*, 108*b*, 125*a*, and 125*b* via the rubber bushings 51*a* and 52*a*. By virtue of the elasticity of the rubber bushings 51*a* and 52*a*, it is possible to offset an installation clearance formed when the tub front 100 and tub rear 120 are installed. By virtue of the elasticity of the rubber bushings 51*a* and 52*a*, it is also possible to reduce or damp vibration and impact generated between each of the tub front 100 and tub rear 120 and a corresponding one of the tub support front 50 and tub support rear 55.

In accordance with the laundry machine of the illustrated embodiment, it is possible to greatly increase the diameter of the tub because the tub is directly fixed to the base 600, so that it does not move. As a result, it is possible to greatly increase the capacities of the tub and drum. In addition, there is an effect of improving the overall vibration characteristics because the tub is fixed to the base 600.

Hereinafter, a tub support structure of the laundry machine according to a second embodiment of the present invention will be described with reference to the accompanying drawings.

FIG. 13 is a perspective view illustrating the laundry machine according to the second embodiment of the present invention. FIG. 14 is a sectional view illustrating the laundry machine according to the second embodiment of the present invention.

As shown in the drawings, the tub support structure according to the second embodiment of the present invention includes a tub support front 60 and a tub support rear 70. The tub support front 60 is fixedly mounted to the base 600, to support a lower portion of the tub front 100. The tub support rear 70 is fixedly mounted to the base 600, to support a lower portion of the tub rear 120.

Support structures supported by the tub support front 60 and tub support rear 70 are additionally formed at the lower portions of the tub front 100 and tub rear 120, respectively.

A plurality of front fitting protrusions 62 are formed at the lower portion of the tub front 100 such that the front fitting protrusions 62 are fitted in the tub support front 60. Each front fitting protrusion 62 has a wedge shape having an inverted triangular cross-section. A fastening groove 64 is formed through each front fitting protrusion 62 in a direction parallel to the axial direction of the tub front 100. A fastener such as a bolt or a screw is fastened into the fastening groove 64.

A plurality of rear fitting grooves 72 are formed at the lower portion of the tub rear 120, so as to be supported by the tub support rear 70. Each rear fitting groove 72 has a cylindrical shape.

The tub support front 60 is mounted to a front central portion of the base 600 by separate fasteners (for example, screw bolts (not shown)). The tub support front 60 includes a tub support front body 61 to form a support height for the tub front 100. Front fitting grooves 63 are formed at an upper portion of the tub support front body 61. The front fitting protrusions 62 of the tub front 60 are fitted in the front fitting grooves 63, respectively. Each front fitting groove 63 has an inverted triangular shape corresponding to the shape of the front fitting protrusions 62.

The front fitting grooves 63 may have a slot shape having an inverted triangular cross-section. Where the front fitting grooves 63 have a slot shape, the front fitting protrusions 62 of the tub front 100 may have an installation clearance in a forward/rearward direction. A stopper 65 is formed at a front end of each front fitting groove 63, to limit movement of the front fitting protrusion 62 fitted in the front fitting groove 63.

A fastening hole 67 is formed through each stopper 65. A fastener is fastened into the fastening hole 67, so that the front fitting protrusion 62 is fixedly mounted to the front fitting groove 63.

The tub support rear 70 is fixedly mounted to a rear central portion of the base 600 by separate fasteners (for example, screw bolts (not shown)), the tub support rear 70 includes a tub support rear body 71 to form a support length of the tub rear 120. Rear support protrusions 74 are formed at an upper portion of the tub support rear body 71. The rear support protrusions 74 are fitted in the rear fitting grooves 72 of the tub rear 120, respectively.

Each rear support protrusion 74 is provided with a cylindrical rubber bushing 76 so that the rear support protrusion 74 is tightly fitted in the corresponding rear fitting groove 72. The rubber bushing 76 may be made of a rubber material having certain elasticity. By virtue of the elasticity of the rubber bushing 76, it is possible to offset an installation clearance caused by a dimensional error formed when the tub rear 120 is installed.

Although the tub support structure of the second embodiment has been described under the condition that the constituent elements thereof are distinguished as the tub support front 60 and tub support rear 120, the constituent element as the tub support front 60 may be arranged at the rear side of the tub, and the constituent element as the tub support rear 70 may be arranged at the front side of the tub. That is, in the present invention, the positions of the tub support front 60 and tub support rear 70 are not limited.

Coupling of the above-described tub support structure according to the second embodiment of the present invention will be described.

The tub support front 60 is centrally installed at the front side of the base 600, to support a weight applied at the front side of the tub. The front fitting protrusions 62 of the tub front 100 are fitted in the front fitting grooves 63 of the tub support front 60, respectively. Movement of the front fitting protrusions 62 fitted in the front fitting grooves 63 is limited by the stoppers 65. The front fitting protrusions 62 fitted in the front fitting grooves 63 are fixed by fasteners fastened into the fastening holes 67 formed through the stoppers 65.

The tub support rear 70 is centrally installed at the rear side of the base 600, to support a weight applied at the rear side of the tub. The rear support protrusions 74 of the tub support rear 70 are fitted in the rear fitting grooves 72 of the tub rear 120. Movement of the rear support protrusions 74 fitted in the rear fitting grooves 72 is limited by the rear fitting grooves 72.

The rear support protrusions 74 may be fitted in the rear fitting grooves 72 via the rubber bushings 76. By virtue of the elasticity of the rubber bushings 76, it is possible to offset an installation clearance formed when the tub is installed. By virtue of the elasticity of the rubber bushings 76, it is also possible to reduce or damp vibration and impact generated between the tub front 60 and the tub rear 70.

Hereinafter, a tub support structure of the laundry machine according to a third embodiment of the present invention will be described with reference to the accompanying drawings.

FIG. 15 is a perspective view illustrating the laundry machine according to the third embodiment of the present invention. FIG. 16 is an exploded perspective view illustrating a coupled state of the laundry machine according to the third embodiment of the present invention.

The tub support structure according to the third embodiment of the present invention includes a plurality of support ribs 80 formed at the outer circumferential surface of the tub, and a plurality of supporters 90 provided at the base 600, to support the support ribs 80.

As shown in the drawings, the support ribs 80 are protruded from lower portions of the outer circumferential surfaces of the tub front 100 and tub rear 120. The support ribs 80 are arranged in plural at the tub front 100 while being arranged in plural at the tub rear 120. Although the support ribs 80 respectively arranged at the tub front 100 and tub rear 120 are different in terms of formation direction and formation position, they have the same configuration. Accordingly, the support ribs 80 will be described only in conjunction with one support rib 80, without being described for all support ribs 80.

Each support rib 80 is protruded, in a direction orthogonal to the axial direction of the tub, from a lower portion of a greatest-diameter section of the tub front 100 or tub rear 120. An engagement protrusion (not shown) is protruded from a lower end of each support rib 80, to limit the coupling position of the support rib 80 to the corresponding supporter 90. At one side of each support rib 80, a fastening hole 84 is formed, to couple the support rib 80 to a coupling rib 93 formed at the corresponding supporter 90 by a separate fastener. The supporter 90 will be described later.

Meanwhile, the supporters 90 are provided at respective corners of the base 600. Preferably, the supporters 90 are installed to be in close contact with corner portions of the base 600 to which the cabinet front (not shown) cabinet rear 620, cabinet right 630, and cabinet left 640 of cabinet covers coupled to respective outer sides of the base 600 are adjacent.

The supporters 90 may be provided in plural at the base 600. Although the supporters 90 are different in terms of installation direction and installation position, they have the same configuration. Accordingly, the supporters 90 will be described only in conjunction with one supporter 90, without being described for all supporters 90.

Each supporter 90 includes an elongated body 91 coupled to the base 600, a seat 92 formed at an upper end of the body 91, to support the corresponding support rib 80 formed at the tub in a seating manner, and an engagement groove 94 formed at the seat 92, to receive the engagement protrusion 82 formed at the corresponding support rib 80.

A coupling rib 93 is formed at one side of the seat 92. The coupling rib 93 extends toward a lower end of the support rib 80. A coupling hole 95 is formed through the coupling rib 93 such that the coupling hole 95 corresponds to the fastening hole 84 formed at the corresponding support rib 80. The coupling hole 95 and fastening hole 84 are fastened to each other by a separate fastener.

Meanwhile, the body 91 of each supporter 90 fixedly mounted to the base 600 is arranged at a corresponding one of vertical corner portions defined by the cabinet front (not shown) cabinet rear 620, cabinet right 630, and cabinet left 640 coupled to the base 600. The body 91 of each supporter 90 may be firmly coupled to a corresponding one of the cabinet portions by a separate fastener (not shown).

In accordance with the laundry machine of this embodiment, it is possible to greatly increase the diameter of the tub because the tub is directly fixed to the corners of the base 600 and cabinet, so that the tub does not move. As a result, it is possible to greatly increase the capacities of the tub and drum.

Since the tub is fixedly mounted to the base 600 and cabinet, the tub does not vibrate alone, but vibrates under the condition that the weight of the cabinet is added to the tub. As a result, the rigidity of the tub is increased. In addition, there may be an effect of improving the overall vibration characteristics of the drum washing machine.

It should be understood that the terms used for constituent elements in the specification and appended claims should not be construed as limited to general and dictionary meanings. Although at least a part of the terms are designated for convenience of description, but the materials, functions, shapes, etc. of the constituent elements are not limited thereto. It should be understood that the constituent elements of the present invention are defined and construed by the functions and roles thereof.

The invention claimed is:

1. A laundry machine, comprising:

a cabinet having a base;

a tub fixedly mounted at a front of the cabinet to hold water therein, the tub having horizontally flat portions at lower front and rear central portions thereof that extend downward from an outer circumference of the tub; each having a fitting protrusion;

a drum rotatably placed in the tub;

a drive assembly including a shaft that extends through the tub and is connected to a rear wall of the drum, a bearing housing that rotatably supports the shaft, and a motor to rotate the shaft;

a damper bracket attached to the bearing housing;

a suspension attached to the damper bracket and that flexibly supports the drive assembly separately from the supporting of the tub;

a flexible material to prevent the water inside the tub from leaking toward the drive assembly and allow the drive assembly to move relatively to the tub; and a support that supports the tub at a circumferential surface of the tub at the lower front and rear central portions thereof, separately from the supporting of the drive assembly and separate from the suspension, wherein the support includes:

a front supporter separate from the cabinet and installed at a front side of the base, wherein the front supporter supports a front side of the tub and connects the lower front central portion of the tub directly to the base to rigidly support the tub with respect to the base and prevent a vertical movement of the tub with respect to the base; and a rear supporter separate from the cabinet and installed at a rear side of the base, wherein the rear supporter supports a rear side of the tub and connects the lower rear central portion of the tub directly to the base to rigidly support the tub with respect to the base and prevent the vertical movement of the tub with respect to the base, wherein the tub is installed in the cabinet in a tilted state, wherein each of the flat portions of the tub is formed with a slant such that a front portion is higher than a rear portion thereof, wherein the fitting protrusions of the lower front and rear central portions mate with corresponding support grooves of the front supporter and the rear supporter, the corresponding support grooves being slantingly formed to be parallel to a tilting direction of the tub when the tub is installed in the cabinet in the tilted state, a distance between the base and the lower front and rear central portions of the tub is the same.

2. The laundry machine according to claim 1, wherein the tub is supported by the support at at least 3 locations on the circumferential surface of the tub.

3. The laundry machine according to claim 1, wherein the tub is further supported at a front or rear wall surface of the tub.

4. The laundry machine according to claim 1, wherein the cub is formed with at least one front fitting groove that protrudes from the front lower central portion of the tub, and wherein the front supporter is formed with at least one front fitting protrusion, which is fitted in the at least one front fitting groove.

5. The laundry machine according to claim 4, wherein the fitting protrusion of the lower front central portion of the tub has a wedge shape having an inverted triangular cross-section, and wherein the corresponding groove of the front supporter has an inverted triangular shape corresponding to the shape of the fitting protrusion of the lower front central portion of the tub.

6. The laundry machine according to claim 5, wherein a fastening hole is formed at one side of the corresponding groove of the front supporter, to allow a fastener to extend through the fastening hole, and wherein a fastening groove is formed at one side of the fitting protrusion of the lower front central portion of the tub at a position corresponding to the fastening hole, to allow the fastener to be fastened into the corresponding groove.

7. The laundry machine according to claim 1, wherein the at least one front fitting protrusion includes a pair of front fitting protrusions, and the at least one front fitting groove includes a pair of front fitting groves.

8. The laundry machine according to claim 7, wherein the pair of front fitting protrusions corresponds in shape to the pair of front fitting grooves.

9. The laundry machine according to claim 7, wherein the pair of front fitting protrusions and the pair of front fitting grooves extend in a lateral direction of the laundry machine.

10. The laundry machine according to claim 1, wherein the tub is formed with at least one rear fitting groove recessed from the lower rear central portion of the tub, and wherein the rear supporter is formed with at least one rear support protrusion to be fitted in the at least one rear fitting groove.

11. The laundry machine according to claim 10, wherein the at least one rear fitting groove has a cylindrical shape, wherein the at least one rear support protrusion includes a cylindrical support made of an elastic material, and wherein the cylindrical support is fitted in the at least one rear fitting groove to support the tub.

12. The laundry machine according to claim 10, wherein the at least one rear support protrusion includes a pair of rear support protrusions, and the at least one rear fitting groove includes a pair of rear fitting groves.

13. The laundry machine according to claim 12, wherein the pair of rear support protrusions corresponds in shape to the pair of rear fitting grooves.

14. The laundry machine according to claim 13, wherein the pair of rear support protrusions and the pair of tear fitting grooves extend in a lateral direction of the laundry machine.

15. The laundry machine according to claim 1, wherein the tub includes at least one fitting groove respectively formed at front and rear lower portions of the tub, and wherein the front supporter and the rear supporter include at least one support protrusion to be coupled with the at least one fitting groove of the tub, respectively.

16. The laundry machine according to claim 15, wherein the fitting protrusions of the lower front and rear central portions each have a wedge shape having an inverted triangular cross-section, and wherein the corresponding grooves each have an inverted triangular shape corresponding to the shape of the fitting protrusion.

17. The laundry machine according to claim 16, wherein a fastening hole is formed at one side of the corresponding groove of the front supporter to allow a fastener to extend through the fastening hole, and wherein at least one fastening groove is formed at one side of the fitting protrusion at a position corresponding to the fastening hole to allow the fastener to be fastened into the corresponding groove.

18. The laundry machine according to claim 15, wherein the fitting grooves of the tub each has a cylindrical shape, wherein the support protrusions of the front and the rear supporters each includes a cylindrical support made of an elastic material, and wherein the cylindrical supports are fitted in the fitting grooves of the tub to support the tub.

19. The laundry machine according to claim 1, wherein:

the front supporter supports a weight of the tub and controls a horizontal movement of the tub; and the rear supporter supports the weight of the tub.

20. The laundry machine according to claim 1, wherein the front supporter supports a weight of the tub and controls a horizontal movement of the tub; and the rear supporter supports the weight of the tub and controls the horizontal movement of the tub, wherein the rear supporter has the same shape as the front supporter.

21. The laundry machine according to claim 15, wherein the at least one fitting groove and the least one support protrusion includes a pair of fitting grooves and a pair of support protrusions, respectively.

22. The laundry machine according to claim 21, wherein the pairs of fitting grooves and support protrusions correspond in shape.

23. The laundry machine according to claim 21, wherein the pairs of fitting grooves and support protrusions extend in a lateral direction of the laundry machine.

* * * * *